US006715758B1

(12) United States Patent
Shinderman

(10) Patent No.: US 6,715,758 B1
(45) Date of Patent: Apr. 6, 2004

(54) EUROPEAN FOOTBALL GAME

(76) Inventor: Alexander Shinderman, P.O. Box 1981, Ramat-Gan (IL), 52118

( * ) Notice: Subject to any disclaimer, the term of this patent is extended or adjusted under 35 U.S.C. 154(b) by 0 days.

(21) Appl. No.: 09/889,987

(22) PCT Filed: Nov. 29, 1999

(86) PCT No.: PCT/IL99/00642

§ 371 (c)(1),
(2), (4) Date: Jul. 19, 2001

(87) PCT Pub. No.: WO01/37954

PCT Pub. Date: May 31, 2001

(51) Int. Cl.[7] ..... A63F 3/00
(52) U.S. Cl. ..... 273/247; 273/259; 273/277
(58) Field of Search ..... 273/243, 244, 273/247, 259, 277, 441

(56) References Cited

U.S. PATENT DOCUMENTS 1,661,216 A * 3/1928 Destefano ..... 273/244
5,046,743 A * 9/1991 Salerno ..... 273/247
5,221,084 A * 6/1993 Stelmach ..... 273/247
5,476,263 A * 12/1995 Romaniello ..... 273/244
6,193,233 B1 * 2/2001 Lipman ..... 273/138.1

FOREIGN PATENT DOCUMENTS

GB 2095568 A * 10/1982 ..... A63F/3/00
GB 2181961 A * 5/1987 ..... A63F/3/00

* cited by examiner

*Primary Examiner*—Vishu K Mendiratta

(57) ABSTRACT

The method of playing football game is the succession of actions characterized by the following: the two players in turn are rolling dice and moving by one move one of their player pieces across the squares of the game board, which are not occupied by other player pieces and ball player piece to the number of squares up to the number appearing on the roll of the said dice to the directions which the players are choosing, if the player piece or the goal keeper player piece reaches the square which is occupied by ball player piece, the said player pieces catch the ball player piece and after the repeated throw of dice (out of turn in this case) the player moves the ball player piece upon the said game board until the moment when the ball player piece crosses his opponent's goal line.

8 Claims, 5 Drawing Sheets

EUROPEAN FOOTBALL GAME

BACKGROUND OF THE INVENTION

The present invention relates to the game of playing football, which can be played by two opposing players on the game board.

The game board represents a football field, each player has player pieces which are moving on the game board by means of rolling of a dice. The game is intended for children from the age of 8 to 15 years and also for adults.

There are known the following analogous inventions:

1. Football board game, which is covered by the U.S. Pat. No. 5,356,152, issue date Oct. 18, 1994 inventor Curry, Kevin P.
2. Football board game, which is covered by the U.S. Pat. No. 5,217,229, issue date Jun. 8, 1994 inventor Jaime, Francisco.
3. Method of playing chess football, which is covered by the U.S. Pat. No. 4,443,011 issue date Apr. 17, 1994 inventor Sheridan, Raymond.

The U.S. Pat. No. 4,443,011 "Method of playing chess football" (inventor R. Sheridan) has characteristics which are most similar to that of my invention. The said invention also relates to the game of playing football, which can be played by two opposing players on the game—board which is divided into squares; the players have player pieces and move them by rolling the dice. But the said invention has the following defects:

1. When the author named his invention the method of playing chess football, he didn't realize the conception of chess game. In his game, two players during one move are moving all of their player pieces simultaneously, while in a chess game in one move only one figure can be moved.
2. The game is intended for playing American football. On the game board a football field for American football is represented and this game board is impossible to use for playing European football (soccer).
3. For the movement of the player pieces upon the game board the two players in turn are rolling one die and move all of their player pieces. This procedure is repeated by each player. One more die is being added to each of said rolls until there has in fact occurred the roll of four dice by each player. The said movement is realized for 29 pieces (22 players, 5 referee marker pieces and two ball marker pieces).

The direction and distance of all kicks are determined by rolling of three dice and also by the use of two markers. All said drawbacks complicate the game, and that's why it's impossible to use the said invention game for children.

The proposed device (invention) imitates the game board of European football and it is the playing model of it. In my invention the conception of chess is realized. The game board is divided into squares, the players are rolling the dice in turn and during one move they are moving only one player piece.

The direction of the movement of the said pieces the players choose themselves. The said movement is very much alike to the movement of the figure of queen in the chess game.

At the same time in the game, it is necessary to think of all of the moves with regard to the probable appearance of the numbers of points on the dice. These elements highly develop the thinking of children and make the game more interesting. I, as the inventor of the game, had the opportunity to check it many times when I played with my 17 year old son and his friends more than 150 games, and I have collected the statistics of the proposed game.

BRIEF SUMMARY OF THE INVENTION

One embodiment of the present invention provides a method for playing European football board game.

The method of playing European football board game is characterized by the following: the two players in turn roll the dice and move by one move one of their player pieces across the squares of the game board, which are not occupied by other player pieces and ball player piece to the number of squares according to the number of points appearing on the upper side of the said dice, according to the player's choice from the dice to the directions which the players are choosing-lateral to the right and to the left, directly vertical forward and backward, diagonally up to the right and to the left, backward diagonally to the right and to the left from the square which is occupied by the said player piece. If the player piece or the goal keeper player piece reaches the square which is occupied by ball player piece (according to the number of points appearing on the said dice), the said player pieces catch the ball player piece and after the repeated throw of dice (without turn in this case) the player moves the ball player piece upon the said game board, to the said directions across the squares which are not occupied by others player pieces. It is not allowed to hold the ball player piece for a player. In the case when the ball player piece and the player piece occupy the same square, the player always moves first the ball player piece after the repeated throw of dice. If the ball player piece is moved from the player piece to player piece of the same player, he throws the dice once more, if not—the second player throws the dice. The player moves the ball player piece upon the said game board until the moment when the ball player piece crosses his opponents goal line.

Another embodiment provides a game system. It includes the game board, and the player pieces,.characterized by the purpose to simplify the game and to raise the interest of it. The game board has a rectangular shape, on which are represented (pictured) a real football field with goal line, goal area, penalty area and half way line. The same game board is divided into the squares (12 squares along its length and 8 squares across its width), which are necessary for moving on the said game board, by the said method, by 13 player pieces (5 player pieces and 1 goal—keeper player piece from each side and ball player piece).

The system also includes the dice with six sides on each die and with a definite number of points on these sides. There are two sides with one point on each side, two sides with two points on each side; one side with 3 points and one with 4 points.

The said game is played with elements of real European football game:

kicks, pass, penalty, comer kicks.

The winner—whoever scored more goals during the game.

BRIEF DESCRIPTION OF THE DRAWINGS

The game board with the playing football field on it is illustrated on FIG. 1.

DETAILED DESCRIPTION OF THE INVENTION

Figure 1:
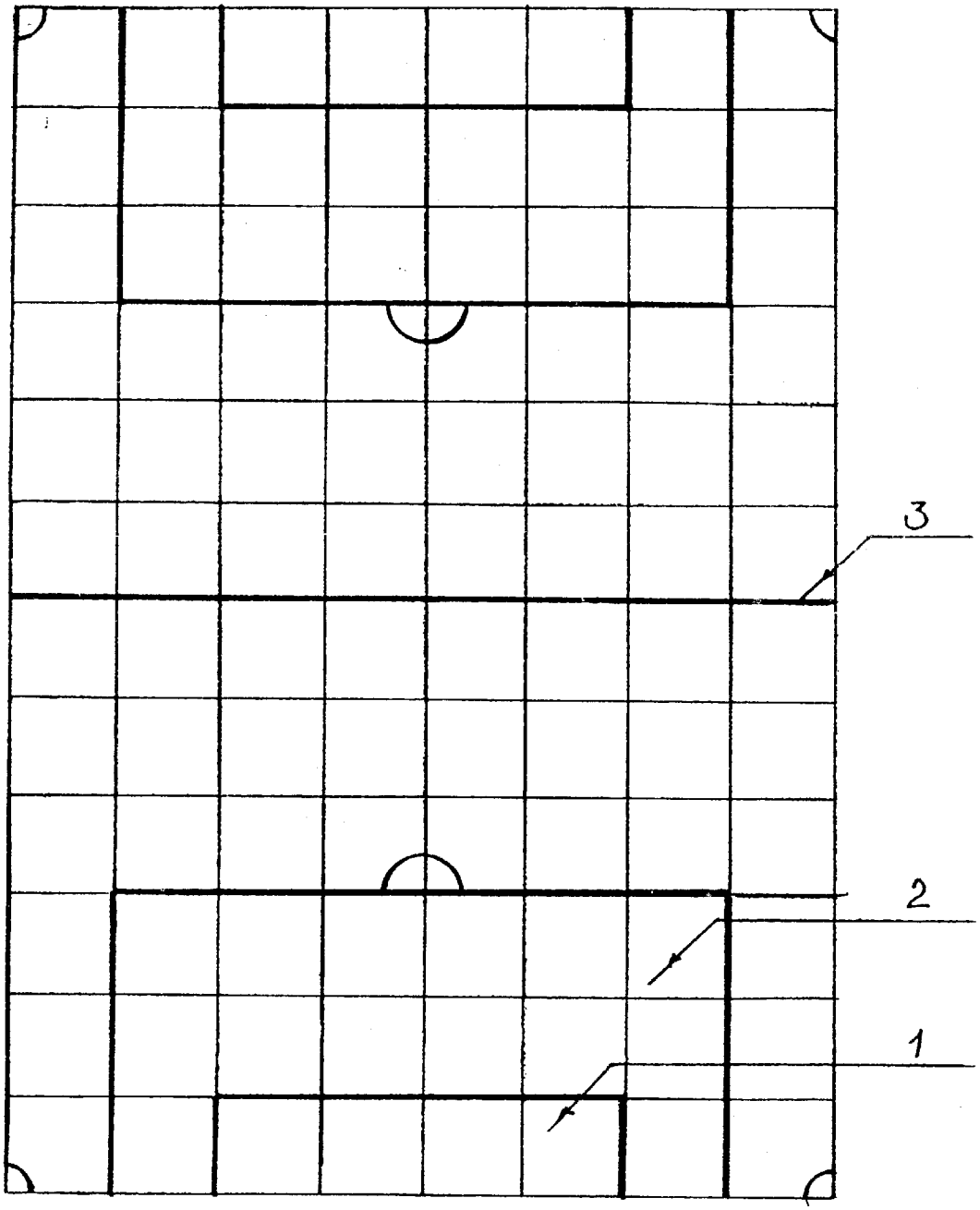

As it is illustrated in FIG. 1, the game board utilized in accordance with the invention has a rectangular shape and is divided into squares-twelve squares along its length and eight squares across its width. The game board includes a representation of a football field, and has the goal area (1) and the penalty area (2). The football field is divided into two halves by half way line (3).

The goal area is intended for the goal-keeper-player piece, the other player pieces (5 player pieces from each side of players), are playing on the football field outside of the goal area. Into the goal area player pieces are playing in accordance with the rules which will be described hereinafter. A ball player piece and two dice (move fixing means) are also used for the said game. The dice determine the range of player pieces movement. Each player piece is moving upon the game board corresponding to the number of points appearing on the upper side of the previously thrown dice. Every die has six faces and a definite quantity of points on its sides. There is one point on every of the two sides, there are two points on the other two sides, on the one side there are 3 points, and on the one side—4 points. Correspondingly all player pieces are moving on the game board on 1, 2, 3 or 4 squares—corresponding to the number of points which are appearing on the upper side of the said dice. It is possible to use only one die or more than two dice, and also the dice with other combinations of points on its side.

Each player in his turn throws the dice, chooses the number of points he wants from two dice and moves one of his player pieces or the goalkeeper—player piece. The ball player piece is moving if the player piece of one of the players occupies the same square on the game board which is occupied by the ball player piece. According to this rule, the player must repeat the throw of the dice.

Figure 2:
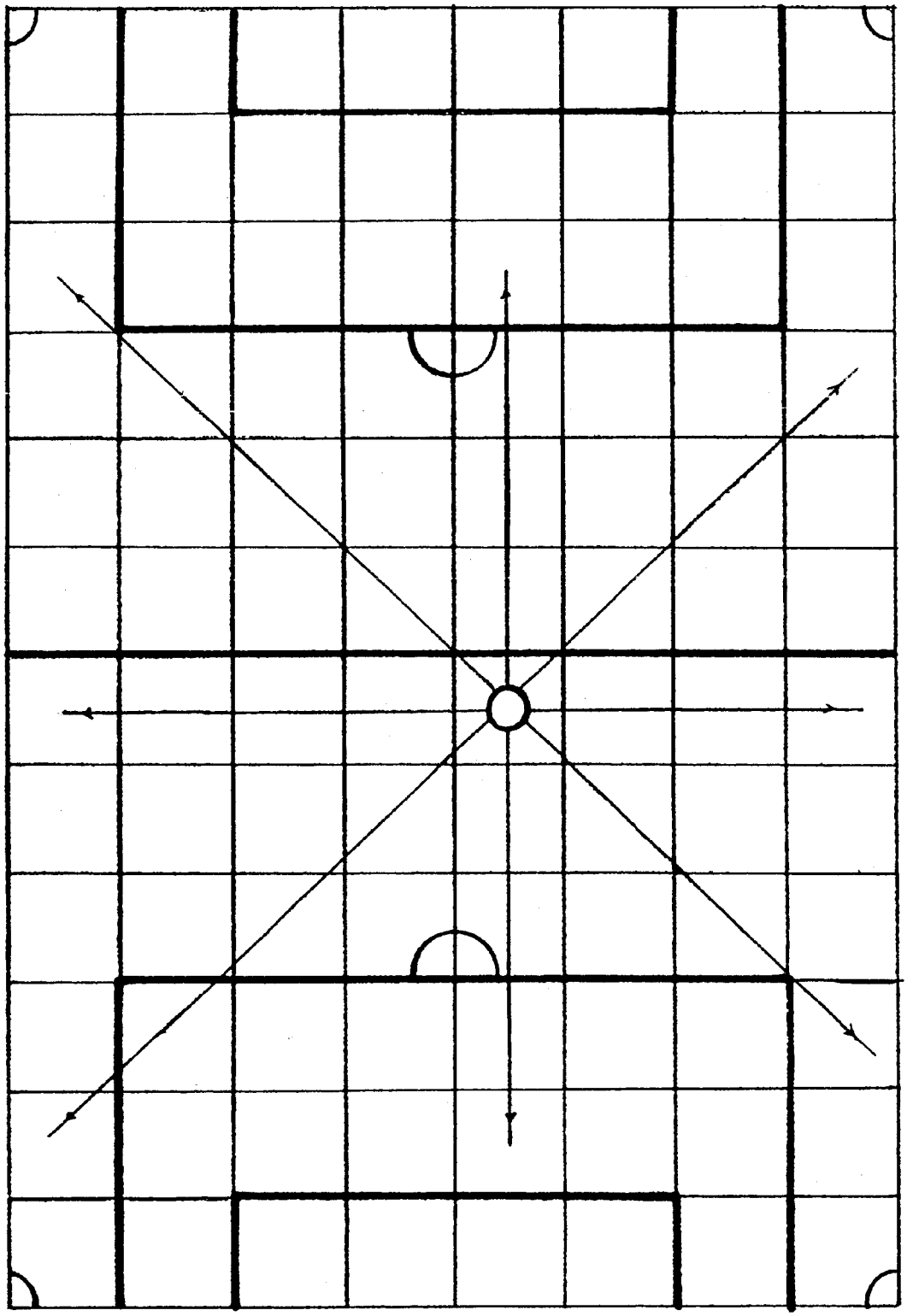
FIG. 2 shows all possible variants of the player pieces movement upon the game board according to the points which appear on the upper side of the dice.

The procedure is repeated by the player during the game whenever his player piece is in the same square where there is the ball player piece. All the possible variants of the movement of player pieces and ball player piece are illustrated in the FIG. 2.

The pointers (hands) illustrate the directions of the player piece movement corresponding to the number of points which are appearing on the upper side of the said dice for 1, 2, 3 or 4 squares. The directions of the said movement are to the right and to the left horizontally (across) the playing board, diagonally up to the right and to the left, backward diagonally to the right and to the left and up and down vertically from the square which is occupied by the said player piece. Each player piece is moving only across the squares which are not occupied by the other player pieces.

Figure 3:
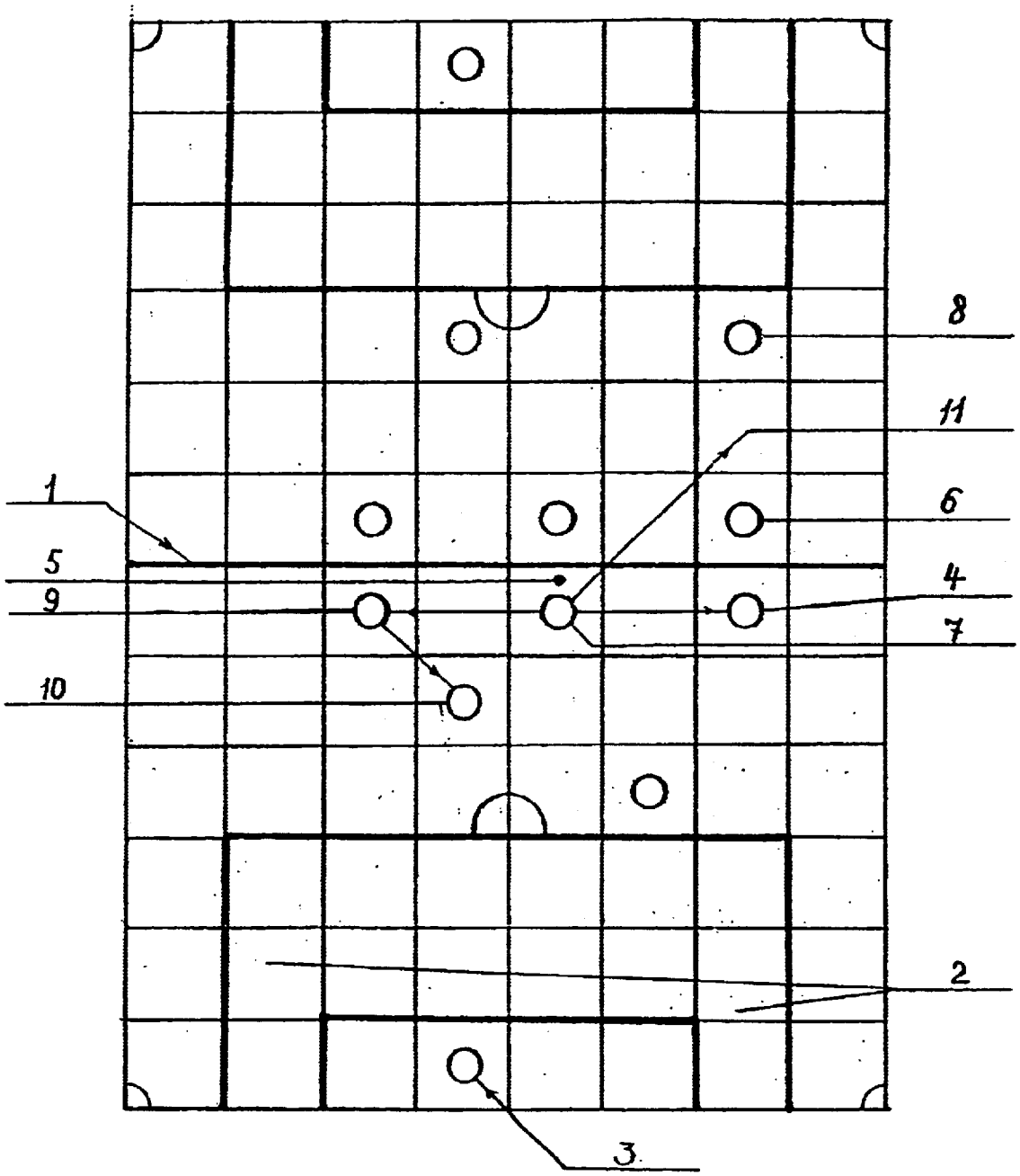
FIG. 3 sets forth the start position of player pieces at the beginning of the game and possible variants of player pieces and ball player piece movements during the game according to the points which appear on the upper side of the dice.

FIG. 3 shows the start position of player pieces on the game board before the beginning of the game. Before the beginning of the game, player pieces are occupying the squares of a half of the game board and don't cross the central half line (1).

The goal—keeper piece (3) in the beginning of the game occupies one of the squares of the goal area. Ball player piece (5) occupies the central square of the game board and the same central square is occupied by the player piece (7) of the team (player) who starts the game.

This is determined before the beginning of the game by the dice. In order for the game to be successful on the 6 squares of the penalty area which are in front of the goal area (2), during the whole game, there must be no more than one player piece (except the goalkeeper piece).

In the case of an infringement of this rule must be executed a punishment—a penalty for the benefit of the other team.

All the other player pieces are placed on the game board arbitrarily before the beginning of the game.

Let's have a look how to play the football game according to the said rules of the player pieces movements with the help of the dice. The position of players before the game is illustrated on the FIG. 3. Suppose that after the throw of the dice 2 points appeared on upper side of the dice. The ball player piece may be moved from player piece (7) to the player piece (4) or to the player piece (9) or, in accordance which the decision of the player, move forward to 2 squares diagonally (11) (as illustrated by pointers on the FIG. 3).

If the ball player piece is moved from player piece (7) to player piece (9)—the player throws the dice once more. If after this one point appears on the upper side of the dice, the player can move the ball back to the player piece (10)—FIG. 3.

If the ball player piece is moved from player piece (7) (the start of the game) to the two squares forward diagonally (11)—FIG. 3, in this case, it is the opposing player's turn to throw the dice. If one point appears on the dice, in this case, the opposing player moves his player piece (6) or (8), and occupies the same square which is occupied by ball player piece. The opposing player in this case throws the dice once more, and it's possible to move the ball player piece forward or to his other player piece accordingly with the player's decision. The ball player piece is always moving and it is not allowed to hold it for any of the players, in the case when the ball player piece and the player piece occupy the same square, the player always moves first the ball player piece after the repeated throw of the dice.

If the ball player piece during the game isn't taken by the players, in this case the players throw the dice in turn and move their player pieces in accordance with the number of the points which appear on the upper side of the dice. This is the imitation of a game without a ball, as there is in fact a football game.

The aim of the game, as it was described in the text, is to score a goal. In this case, the ball player piece must cross the goal line. For this aim, the ball player piece is moving to the goal.

Figure 4:
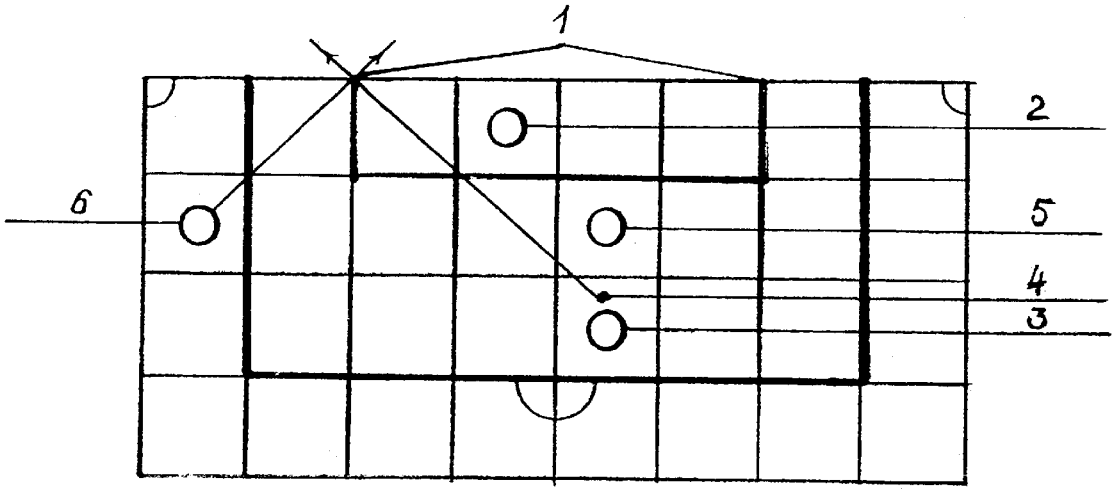
FIG. 4 shows the rules of scoring a goal in the game.

The borders (crossbars) of the goal (1) are illustrated on FIG. 4. The player scores a goal if after the throw of the dice the ball player piece according to the points appearing on the upper side of the said dice, cross the squares on the goal line between the borders (crossbars) of the goal. The situation of the scoring of a goal is illustrated on FIG. 4. Goal player piece (2) of the opposing player (defensive team) is on the goal line, the player piece of the player (offensive team) (3) and the ball player piece are in the square opposite of the goal. The player piece of the defensive team (5) is also in the square opposing the goal near the offensive team's player piece. The offensive team scores the goal if after the throw of the dice appears 3 or 4 points, and, in this case, the ball player piece crosses the goal line (as illustrated on FIG. 4 by pointers). If 2 points appear on the dice, the ball player piece doesn't cross the goal line—it stops on the square of goal line and the offensive team doesn't score the goal. After this, it is the turn of the defensive team to throw the dice. In this case, for example, if on the dice appears 1 point, the goal keeper piece of the defensive team can "catch" the ball player piece, because it comes to the square, where the ball player piece is placed. After the second throw of the dice the defensive team can "kick out the ball" from the penalty area.

In the case when the offensive team's player piece (6) "kicks the ball" from the other position (FIG. 4), it is impossible to score the goal because the ball player piece crosses the goal line outside the borders of the goal as is illustrated by pointer on the FIG. 4. If on the way to the goal there is the defensive team's player piece, it is impossible for the offensive team to score the goal this way because all the pieces are moving only across the vacant squares. As it is illustrated on FIG. 4, the offensive team's player piece (3) can't kick the ball (4) across the square, where the defensive team's player piece (5) is situated.

The goal area is intended for goal keeper player piece, the other player pieces can move into the goal area only to the square where the ball player piece is placed. If it is the offensive team's player piece, it scores the goal by any number of points that appear on the dice. If the defensive team's player piece comes into square where the ball player piece is placed it can pass the ball player piece to the other defensive team's player piece. When the defensive team looses the ball, the player piece, which occupies the square of the goal area, must go out of the goal area by the first move of the defensive team. If all the squares across which the said piece can go out of the goal are occupied, the said piece remains in the goal.

In this case, it means that the offensive team can kick the ball through this square which is occupied by the said piece.

Figure 6:
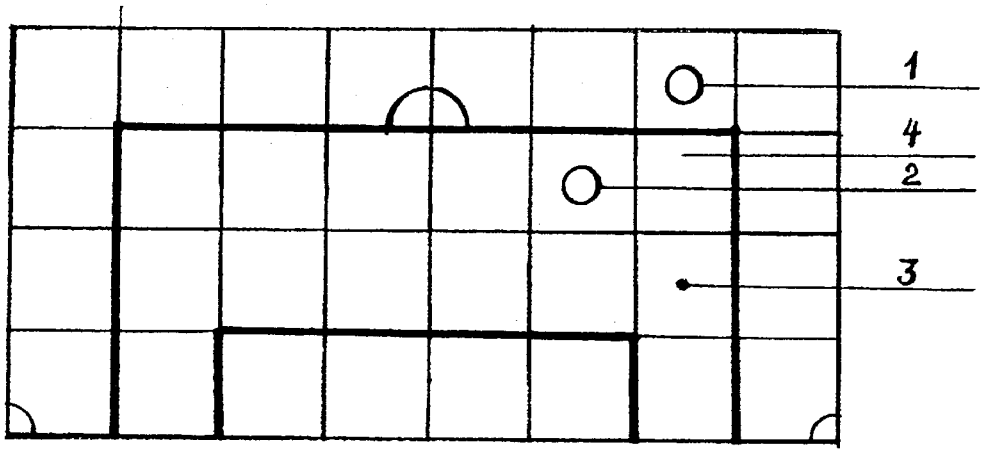
FIG. 6 illustrates the infringement of the game rules inside penalty area.

Penalty. A penalty will be awarded to the offensive team if, firstly, there are two or more player pieces of defensive team (except the goal keeper player piece) in the line (2) in front of the goal area (FIG. 3). Secondly, in the penalty area, it's prohibited to move the player piece of the defensive team (2) into the square (4) between ball player piece and player piece of the offensive team (1), which can catch the ball by the next move (FIG. 6).

Figure 5:
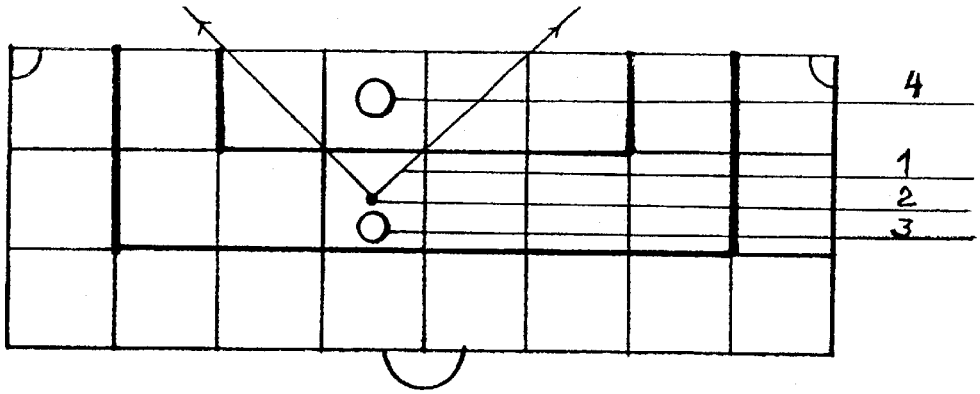
FIG. 5 shows the rules of penalty kick in the game.

Fulfillment of a penalty. A penalty is fulfilled by a player piece of the offensive team (3) from central square (1) of the line before the goal area, where there is also the ball player piece (FIG. 5). The goal keeper player piece occupies one of the squares of the goal area. All of the other' player pieces are removed from the game board.

The dice is thrown and in the case of appearing of two or more points on the dice, the offensive team scores the goal because the ball player piece crosses the goal line in directions which are shown by pointers on FIG. 5. If one point appears on the dice, the offensive team misses the penalty because the ball player piece doesn't cross the goal line. After the penalty, the two players are beginning the game once more as it was described in the text, according to the same rules (FIG. 3).

During the game, it is possible to kick the ball player piece outside of the lateral line and goal line of the game board.

Figure 7:
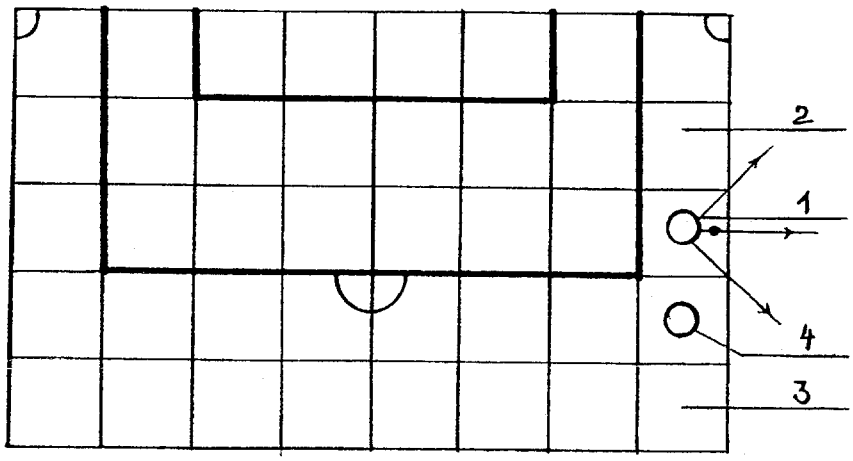
FIG. 7 shows the kicking of the ball player piece out of the lateral line.

The ball player piece is kicked by player piece (1) out of the lateral line according to directions, which are shown by pointers on FIG. 7.

In order to throw the ball player piece back into the game board the player must move one of his player pieces and the ball player piece into the square which is not occupied by any of the player pieces near the square from which the ball player piece was kicked out of the lateral line. The throw is fulfilled by the opposing player (because the player kicked the ball player piece out of the lateral line). As it is illustrated on FIG. 7, the ball player piece can be thrown back into the game from square (2) or from square (3) which is near the player piece (4). The player moves one of his player pieces and the ball player piece into the square (2), rolls the dice and moves the ball player piece across the number of squares according to the points appearing on the upper side of the said dice.

If the ball player piece was kicked outside of the goal line (outside of the bounds of the goal) by offensive team, the defensive team throws the ball back into the game.

Figure 8:
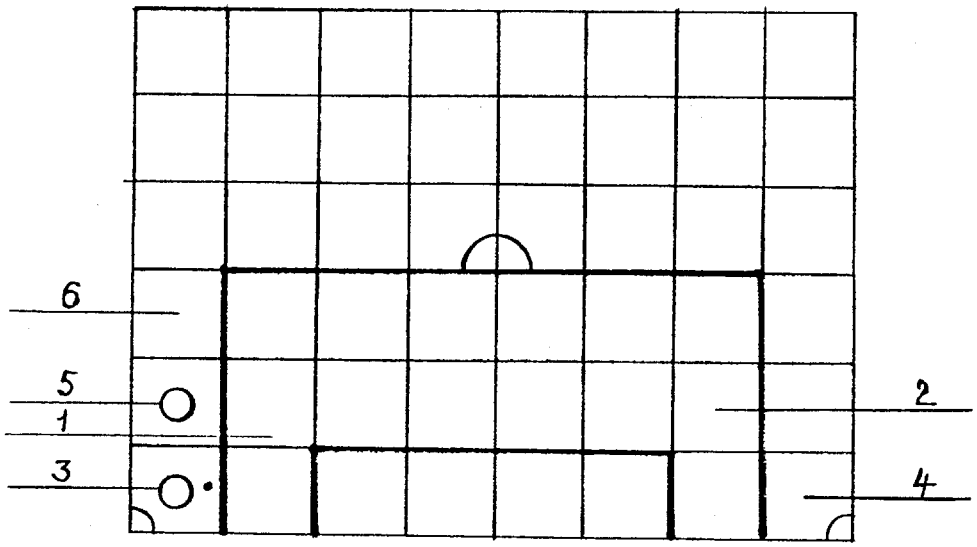
FIG. 8 illustrates the comer kick and the ball player piece kick out of the goal.

The player moves one of his player pieces and the ball player piece into the square (1) (if the ball player piece was thrown out of the left side of the goal), or into the square (2) (if the ball player piece was thrown out of the right side of the goal) (FIG. 8).

Then the player rolls the dice and moves the ball player piece across the number of squares according to the points appearing on the said dice.

If the ball player piece was kicked outside of the goal line by the defensive team (outside of the bounds of the goal), the offensive team throws the ball back into the game by a corner kick. The player moves one of his player pieces and ball player piece into the square (3) (if the ball player piece was thrown out of the left side of the goal) or into the square (4) (if the ball player piece was thrown out of the right side of the goal) (FIG. 8).

The player rolls the dice and moves the ball player piece on the number of squares according to the points appearing on the said dice.

If the square for the corner kick is occupied by the defensive team's player piece, in this case the offensive team kicks the ball from the first vacant square along the lateral line of the playing board (6).

After the corner kick, the offensive team has the opportunity to throw the dice once more and to get the ball by another player piece of the team (but not by the player piece which has fulfilled the corner kick).

The method of playing football, which was described in this text may be realized on the computer.

In this case, the game board (football field), player pieces and the ball player piece are pictured on the display.

The rolls of dice is also pictured on the display. All the moves of the pieces and the rolling of dice is realized by a keyboard or a mouse. The rules of the game are analogous to the rules which were described in the text.

In the regular variant (without the computer), it is possible to make a folding game board, with folding halves which would produce a space for all the pieces and dice to put into that space (analogous to chess).

It is also possible to make a magnetical game board and magnetical player pieces.

It is very handy for playing outside the home—in the field, in the yard, in the park.

The time of the game—30 minutes.

What is claimed is:

1. A method for allowing a player to play a European football board game comprising:

(a) providing: a rectangular board having a length and a width, the board being subdivided into squares and having a first-team goal region and a second-team goal region; at least three first-team playing pieces; at least three second-team playing pieces; a ball piece; and a move value generator;

(b) deploying the first-team playing pieces, the second-team playing pieces and the ball piece in an initial arrangement in separate squares on the board;

(c) making a move for the first team by:

(i) generating a move value, (ii) moving one of the first-team playing pieces a number of squares equal to the move value in a direction chosen by the player from the group of directions: forward parallel to the length, backward parallel to the length, right parallel to the width, left parallel to the width, and diagonal directions forward-right, forward-left, backward-right and backward-left, and (iii) if the moved playing piece reaches the square containing the ball piece, continuing the move by generating a new move value and moving only the ball piece a number of squares equal to the new move value in a direction chosen from the group of directions, such that, at the end of each move, the ball piece and the moved playing piece lie in separate squares of the board;

(d) repeating step (c) for the second team and then alternately for the first and second teams; and (c) counting a goal to the first team when the ball piece crosses a predefined line of the second-team goal region and counting a goal to the second team when the ball piece crosses a predefined line of the first-team goal region.

2. The method of claim 1, wherein, if moving the ball piece results of the ball piece reaching a square containing a playing piece, a further move value is generated and the ball piece alone is moved a number of squares equal to the further move value in a direction chosen from the group of directions.

3. The method of claim 1, wherein the moving of the playing piece is performed exclusively so as not to traverse a square containing a playing piece.

4. The method of claim 1, wherein the moving of the playing piece is performed exclusively so as not to reach a square containing a playing piece other than the ball piece.

5. The method of claim 1, wherein the move value generator is a six-faced die.

6. The method of claim 5, wherein the faces of the die have values no greater than four.

7. The method of claim 1, wherein the board has a length of 12 squares and a width of 8 squares.

8. The method of claim 1, wherein the at least three first-team playing pieces are implemented as six first-team playing pieces and the at least three second-team playing pieces are implemented as six second-team playing pieces.

* * * * *